US006986311B2

(12) United States Patent
Vatsky et al.

(10) Patent No.: US 6,986,311 B2
(45) Date of Patent: Jan. 17, 2006

(54) BURNER SYSTEM AND METHOD FOR MIXING A PLURALITY OF SOLID FUELS

(75) Inventors: Joel Vatsky, Pottersville, NJ (US); Richard E. Conn, Allentown, PA (US)

(73) Assignee: Joel Vatsky, Pottersville, NJ (US)

( * ) Notice: Subject to any disclaimer, the term of this patent is extended or adjusted under 35 U.S.C. 154(b) by 0 days.

(21) Appl. No.: 10/348,624

(22) Filed: Jan. 22, 2003

(65) Prior Publication Data

US 2004/0139894 A1 Jul. 22, 2004

(51) Int. Cl.
*F23C 1/10* (2006.01)
*F23D 1/00* (2006.01)

(52) U.S. Cl. ..... 110/262; 110/347

(58) Field of Classification Search ..... 110/261, 110/262, 263, 342, 347, 218, 219, 232, 255, 110/292, 293, 101 R; 414/160, 586
See application file for complete search history.

(56) References Cited

U.S. PATENT DOCUMENTS 3,124,086 A * 3/1964 Sage et al. ..... 110/264
3,859,935 A 1/1975 Walker
4,059,060 A * 11/1977 Gambs et al. ..... 110/232
4,253,403 A * 3/1981 Vatsky ..... 110/104 B
4,270,895 A * 6/1981 Vatsky ..... 431/183
4,367,686 A * 1/1983 Adrian ..... 110/347
4,434,724 A 3/1984 Kunkel, Jr.
4,466,363 A * 8/1984 Leikert et al. ..... 110/347
4,471,703 A * 9/1984 Vatsky et al. ..... 110/263
4,480,559 A * 11/1984 Blaskowski ..... 110/347
4,528,917 A * 7/1985 Jacobs ..... 110/300
4,589,357 A * 5/1986 Lincoln et al. ..... 110/347
4,960,059 A 10/1990 Berkau et al.
4,984,983 A 1/1991 Enkegaard
5,222,447 A 6/1993 Joshi et al.
5,311,829 A 5/1994 Clark et al.
5,380,342 A 1/1995 Leonard, III et al.
5,697,306 A 12/1997 LaRue et al.
5,765,488 A * 6/1998 Vatsky ..... 110/261
5,950,547 A 9/1999 Wachendorfer
6,101,959 A 8/2000 Bronicki et al.
6,152,054 A * 11/2000 Ashworth et al. ..... 110/345
6,189,464 B1 2/2001 Okazaki et al.
6,199,494 B1 3/2001 Griffin
6,237,510 B1 5/2001 Tsumura et al.
6,260,492 B1 7/2001 Adams et al.
6,279,493 B1 8/2001 Beaumont et al.
6,331,107 B1 12/2001 Philippe
6,405,664 B1 6/2002 Logan et al.
6,439,140 B2 8/2002 Mukai et al.
6,494,153 B1 12/2002 Lyon
6,604,474 B2 * 8/2003 Zamansky et al. ..... 110/342
2001/0007233 A1 7/2001 Mukai et al.
2001/0025591 A1 10/2001 Bool, III et al.
2002/0152937 A1 10/2002 Logan et al.

* cited by examiner

*Primary Examiner*—Kenneth Rinehart
(74) *Attorney, Agent, or Firm*—Lerner, David, Littenberg, Krumholz & Mentlik, LP

(57) ABSTRACT

A burner assembly cofires a primary solid fuel and a secondary solid fuel in a combustion zone of a boiler. The burner assembly includes a fuel injector that mixes the primary solid fuel and the secondary solid fuel prior to injection into the combustion zone of the boiler. The primary solid fuel may be pulverized coal, pulverized petroleum coke, or the like, while the secondary solid fuel may be a biomass fuel or refuse-derived fuel.

42 Claims, 4 Drawing Sheets

BURNER SYSTEM AND METHOD FOR MIXING A PLURALITY OF SOLID FUELS

BACKGROUND OF THE INVENTION

This invention relates generally to solid fuel burner systems and, more particularly, to burner systems that burn or cofire a plurality of types of solid fuels.

One method of cofiring involves the use of a biomass fuel—a renewable source—to provide a low-cost-solution for generating electricity. This method involves cofiring a biomass fuel (e.g., sawdust) as a secondary fuel with pulverized coal (the primary fuel) in a coal-fired boiler. Advantageously, the $CO_2$ emissions from the burning of a biomass fuel is considered to be environmentally benign. In addition, firing biomass fuels results in a reduction in $SO_2$ emissions due to the lower fuel sulfur content compared to coal. Finally, a reduction in $NO_x$ emissions may also be achieved due to the lower nitrogen content of the biomass fuel, coupled with beneficial effects of the volatiles of the biomass fuel during the early stages of combustion.

The potential reduction of $NO_x$ from the cofiring of a biomass fuel with pulverized coal is due to several mechanisms. First, the biomass fuel has a lower fuel nitrogen content than pulverized coal resulting in less $NO_x$ formed from the fuel-bound nitrogen. Second, in a flame a biomass fuel releases volatiles at lower temperatures than pulverized coal. Once released, these volatiles may then react with oxygen, thus inhibiting oxidation of fuel bound-nitrogen released from the pulverized coal. Finally, the volatiles can also force reduction of NO formed in the flame to elemental nitrogen.

Unfortunately, in pulverized coal fired boilers, limitations have been encountered regarding the effectiveness of using a biomass fuel as a means for reducing $NO_x$ emissions. These limitations result from the technique used to cofire the biomass fuel with the pulverized coal.

One technique separately injects the biomass fuel and the pulverized coal into the combustion zone. For example, a pipe is often used to inject the biomass fuel by using transport air in the center of the burner surrounded by the pulverized coal. A diverter is often placed just off the burner face in order to force the flow of biomass fuel radially outward in an attempt to create a recirculation zone in this region. As such, the biomass fuel and the pulverized coal are mixed in the combustion zone, external to the fuel injector. However, this method of cofiring is only partially effective and does not provide the most effective means of utilizing the $NO_x$ reduction benefits of the volatiles in the biomass fuel. In particular, since the pulverized coal is injected separately, the volatiles released from the biomass fuel in the core of the flame may not be able to scavenge oxygen and effectively reduce NO formed from the pulverized coal.

Another cofiring technique involves grinding the biomass together with coal in a mill prior to entering the coal pipe for distribution to the burner. In other words, the biomass fuel is mixed with the primary fuel at the mill. However, the level of biomass cofiring is severely limited by this injection technique due to mill performance. Typically, only about 5 percent biomass fuel (by weight) can be ground in the mill along with coal without causing serious deterioration in mill performance.

As such, although some $NO_x$ reduction benefits may result from the cofiring of a biomass fuel with pulverized coal in wall-fired burners, the existing techniques do not appear to achieve the maximum possible level of $NO_x$ reduction.

It should also be noted that, to date, most of the biomass fuel cofiring in wall-fired boilers has been conducted with turbulent burners that were not designed for low $NO_x$ operation. These burners require precisely controlled stoichiometries in the core of the flame to achieve low $NO_x$ emissions. However, biomass fuels generally have significantly higher oxygen content than pulverized coals and when transported to the burner with air can cause an increase in the stoichiometry in the core of the flame and may increase $NO_x$ formation, thus negating the beneficial $NO_x$ reduction effects of the high volatile content of the biomass fuel.

In addition, no field experience has been demonstrated to date involving the cofiring of a biomass fuel with pulverized coal in current low $NO_x$ burners. However, predictive computer models of current low NOx burners indicate that $NO_x$ may actually increase in a full-scale low $NO_x$ burner flame when cofiring, e.g., sawdust and coal. Thus, current low NOx burner applications do not maximize the beneficial effects of the high volatile content of biomass fuels for $NO_x$ reduction, while inhibiting the effects of their high oxygen content on $NO_x$ formation.

In view of the above, there is a need to improve existing cofiring arrangements that utilize a biomass fuel to maximize the beneficial affects of NOx reduction.

However, besides biomass fuels, other secondary fuels may also be used in a cofiring burner. Petroleum coke is a refinery waste with a high heating value that is considerably lower in price than coal for use as a fuel in a steam boiler. Petroleum coke, unlike coal, is very low in volatile content which makes it hard to ignite and burn out when fired in boilers not specifically designed for this fuel. Typically, the petroleum coke is ground in a mill along with the coal and fed to the burner via a coal pipe. The percentage of petroleum coke that can be fired with the coal is usually limited to about 20 percent by weight, since higher levels will result in flame stability problems due to the low volatile content of the petroleum coke. This limitation is partially due to the fact that petroleum coke is hard to grind and a sufficiently fine size distribution generally cannot be achieved when it is blended with coal and ground in a mill designed for coal. Coarse petroleum coke not only results in flame stability problems, but also leads to a high level of unburned carbon (UBC) in the fly ash. Ideally, cofiring petroleum coke with a high volatile, very reactive coal such as subbituminous or lignite should provide better flame stability than with a less reactive bituminous coal. Unfortunately, these coals typically are also hard to grind, thus often limiting the percentage of petroleum coke that can be ground with them in a mill.

Alternatively, instead of grinding the petroleum coke along with the primary fuel in a mill, U.S. Pat. No. 6,101,959 issued Aug. 15, 2000 to Bronicki et al. describes the use of a mixer for combining a secondary fuel having a higher heating value than the primary fuel. However, there is no description in this patent of the structure of the mixer or its affect on the flame stability and UBC issues with respect to petroleum coke.

As such, although petroleum coke can be cofired with coal in wall-fired burners, a method of cofiring petroleum coke has not been developed that provides maximum flame stability and minimal fly ash UBC while maintaining minimum $NO_x$ emissions.

SUMMARY OF THE INVENTION

In accordance with an aspect of the invention, a burner assembly comprises a mixing element for mixing a primary solid fuel and a secondary solid fuel before injection into a combustion zone. In particular, the burner assembly includes a primary inlet port for receiving a primary solid fuel, a secondary inlet port for receiving a secondary solid fuel, a mixing chamber coupled to the primary inlet port and the secondary inlet port for mixing the primary solid fuel and the secondary solid fuel to provide a mixed solid fuel; and a nozzle for providing the mixed solid fuel to a combustion chamber.

In one illustrative embodiment, a cofiring burner system comprises a burner assembly including a scroll-type fuel injector. The scroll-type fuel injector includes a primary solid fuel port, or inlet, for receiving a primary solid fuel, a secondary solid fuel port, or inlet, for receiving a secondary solid fuel, an outer barrel and a diffuser element. The primary solid fuel and the secondary solid fuel enter the fuel injector tangentially, although alternatively the secondary fuel can enter the fuel injector axially, and are mixed in the outer barrel. The diffuser element is located in the outer barrel to further enhance the mixing of the secondary solid fuel with the primary solid fuel within the fuel injector before injection into the combustion zone.

In another embodiment, a cofiring burner system comprises a burner assembly including a elbow-type fuel injector. The elbow-type fuel injector includes a primary solid fuel port, or inlet, for receiving a primary solid fuel, a secondary solid fuel port, or inlet, for receiving a secondary solid fuel, a barrel and an impeller or other spreading device. The primary solid fuel and the secondary solid fuel enter the fuel injector axially and are mixed in the barrel. The impeller is located within a barrel of the fuel injector coupled to the secondary inlet port to further enhance the mixing of the secondary solid fuel with the primary solid fuel within the fuel injector before injection into the combustion zone.

In an illustrative application of a cofiring burner system comprising a fuel injector that mixes a primary solid fuel with a secondary solid fuel, the primary solid fuel is pulverized coal, and the secondary solid fuel is a highly volatile fuel, such as a biomass fuel.

In another illustrative application of a cofiring burner system comprising a fuel injector that mixes a primary solid fuel with a secondary solid fuel, the primary solid fuel is a low volatile fuel, such as a petroleum coke, and the secondary solid fuel is a highly volatile fuel, such as a biomass fuel.

In another illustrative application of a cofiring burner system comprising a fuel injector that mixes a primary solid fuel with a secondary solid fuel, the primary solid fuel is pulverized coal, and the secondary solid fuel is a low volatile fuel, such as a petroleum coke.

The invention will be better understood from the following brief description of the drawing, detailed description and claims.

DETAILED DESCRIPTION

Other than the inventive concept, the apparatus and methods for a cofiring burner system are well known and are not described further herein. For example, other than the inventive concept, a fuel injector is a portion of the combustion equipment that injects the fuels and carrier gas into a combustion zone. Also, like numbers on different figures represent similar elements.

Figure 1:
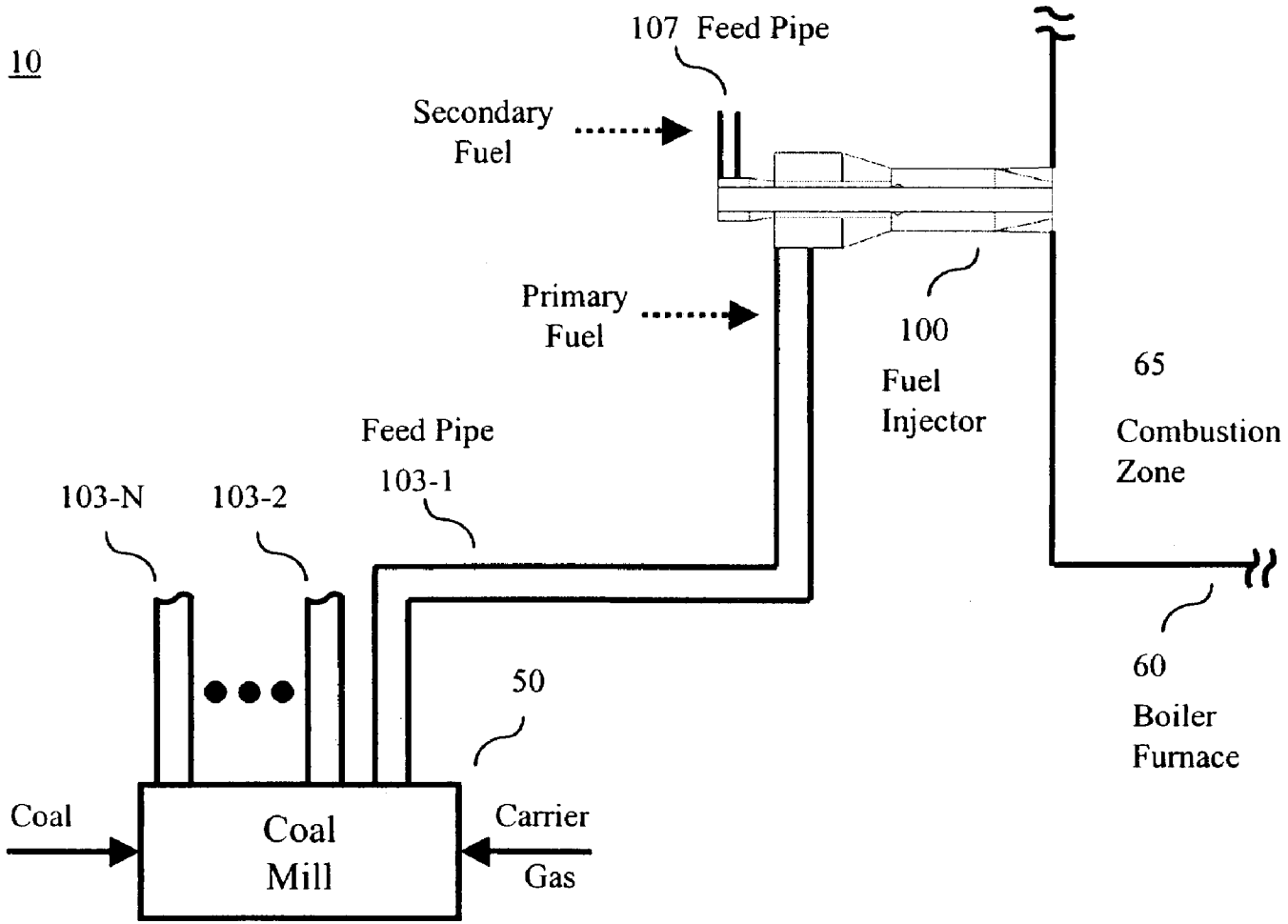
FIG. 1 is a block diagram of a cofire burner system in accordance with the principles of the invention.

An illustrative cofiring burner system in accordance with the principles of the invention is shown in FIG. 1. Cofiring burner system 10 comprises a coal mill (fuel preparation plant) 50, a number of feed pipes, 103-1 to 103-N (primary feed pipes), and 107 (representative of secondary feed pipes), a fuel injector 100 and a boiler furnace, of which a portion 60 is shown (hereafter boiler furnace 60) having a combustion zone 65. Illustratively a primary fuel, e.g., coal, and a transport medium (or carrier gas) (e.g., air) are provided to a fuel preparation plant as represented by coal mill 50, which pulverizes the coal for distribution via the carrier gas to a number of burners via feed pipes 103-1 to 103-N. As used herein, a primary fuel is a fuel that represents more than 50 percent of the total fuel heat input through the combustion process. Other primary fuels may be used, e.g., petroleum coke or a blend of coal and petroleum coke. A secondary fuel (described further below) is also pulverized via a fuel preparation plant (not shown for simplicity) and provided for distribution to the burners using a carrier gas via a number of feed pipes as represented by secondary feed pipe 107 (again, other secondary feed pipes are not illustrated for simplicity).

A representative burner assembly in accordance with the principles of the invention is illustrated by fuel injector 100 of FIG. 1. As described below, fuel injector 100 receives the secondary fuel, via feed pipe 107, and the primary fuel, via feed pipe 103-1, and mixes the primary and secondary fuels to provide a composite fuel mixture to combustion zone 65 of boiler furnace 60. In accordance with an aspect of the invention, fuel injector 100 provides for the intimate mixing of two or more solid fuels prior to the solid fuels entering the combustion zone of a furnace. Illustratively, fuel injector 100 is a component of a low $NO_x$ burner firing into a boiler for steam generation. Fuel injector 100 is the portion of the low $NO_x$ burner assembly that injects the fuels and transport medium (e.g., air) into the combustion zone; surrounding fuel injector 100 is a register assembly (not shown) that supplies secondary air that helps anchor the flame and complete combustion. Fuel injector 100 abuts the combustion zone 65.

Figure 2:
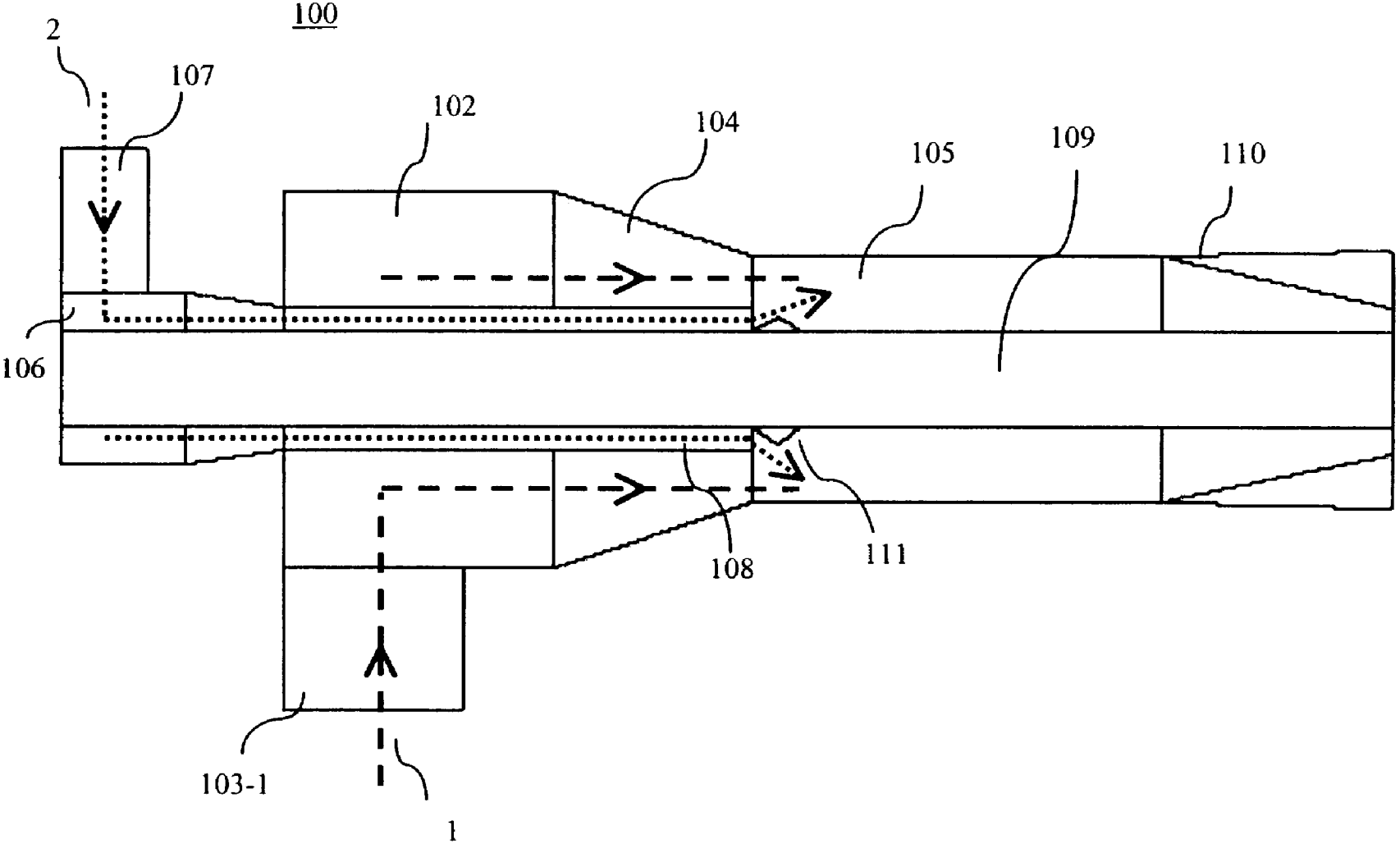
FIG. 2 is a sectional view of a burner assembly in accordance with the principles of the invention.

Turning now to FIG. 2, a more detailed view of fuel injector 100 is shown. Illustratively, fuel injector 100 is a scroll-type injector. Fuel injector 100 injects the primary and secondary solid fuels into the combustion zone 65 of the boiler furnace 60 of FIG. 1. Feed pipes 103-1 and 107 tangentially feed the primary solid fuel and the secondary solid fuel into respective primary and secondary ports, or inlets, of fuel injector 100. Alternatively, the primary solid fuel and/or the secondary solid fuel can enter the fuel injector axially. The primary inlet of fuel injector 100 is primary fuel scroll 102. The flow of the pulverized primary fuel is changed from a tangential direction in scroll 102 to an axial direction exiting the transition section 104 by fuel distribution devices in the scroll and transition section. (Other than the inventive concept, fuel distribution devices in the scroll and transition section of a scroll-type fuel injector are known in the art and not described herein.) The pulverized primary fuel then enters the fuel injector outer barrel 105 at a preferable velocity in the range of 50 to 100 feet per second. The movement of the primary fuel in fuel injector 100 toward outer barrel 105 is illustratively represented in FIG. 2 by dashed line 1.

The secondary inlet of fuel injector 100 is secondary fuel scroll 106 at the end of fuel injector 100. The design of scroll 106 illustratively provides for a preferable tangential velocity in the range of 80 to 150 feet per second and for a preferable axial velocity in the range of 20 to 40 feet per second.

The secondary fuel is fed into the scroll 106 through secondary feed pipe 107 and exits the scroll 106 through an annulus 108 that surrounds an inner barrel 109 of fuel injector 100. The inner barrel 109 may house the burner igniter (not shown). The secondary fuel then enters an outer barrel 105 of fuel injector 100. The movement of the secondary fuel in fuel injector 100 toward outer barrel 105 is illustratively represented in FIG. 2 by dashed line 2. A diffuser 111 may be placed at the exit of the annulus to direct the flow of the secondary fuel outward towards the primary fuel exiting the transition section 104. As a result, and in accordance with an aspect of the invention, the primary fuel and the secondary fuel are intimately mixed in a chamber, e.g., outer barrel 105, of fuel injector 100. The intimately mixed primary and secondary fuels then exit fuel injector tip 110 (or nozzle) with a nearly equal, or even, distribution around the circumference of the tip. With reference to FIG. 2, tip 110 is arranged on a distal end of the burner assembly downstream from the mixing chamber as represented by outer barrel 105.

In accordance with an aspect of the invention, the intimate mixing of the primary solid fuel and the secondary solid fuel within the fuel injector of the burner assembly provides a more homogeneous mixed solid fuel for combustion in a combustion chamber of a boiler furnace. As described below, this further enables a reduction in NOx emissions. In addition, this further enables the use of separate preparation plants for each type of solid fuel, where each preparation plant can be particularly configured to more efficiently pulverize a particular type of solid fuel. Further, the amounts of the primary solid fuel and the secondary solid fuel in the resulting mixed solid fuel can be easily adjusted via the feed pipes from each preparation plant.

One application of fuel injector 100 of FIG. 2 is where the secondary fuel is a high volatile, resource fuel, e.g., a biomass fuel (such as sawdust or the like) or Refuse-Derived Fuel (RDF) that releases volatiles at a lower temperature than the primary fuel. The primary fuel is illustratively pulverized coal. Alternatively, the primary fuel may also be pulverized petroleum coke or a blend of coal and petroleum coke. As the fuel mixture exits the burner tip, the more reactive secondary fuel will act as an oxygen scavenger, thus providing a reducing region during the initial stages of combustion and enhanced $NO_x$ reduction, by maximizing the effect of release of volatiles from the secondary fuel and their subsequent interactions during the early stages of combustion. In addition to reacting with oxygen, these volatiles can also reduce NOx formed from the coal to elemental nitrogen.

In this application, the carrier gas used to transport the resource fuel to the burner is air. However, recycled flue gas or recycled flue gas with air may be used so that the medium has a lower oxygen content than air. The recycling of flue gas is also known as "flue gas recirculation" (FGR). In the context of FIG. 1, the biomass fuel is transported in feed pipe 107 from a fuel preparation plant (not shown) by a carrier gas comprising air, or a flue gas that is recycled after the air heater (not shown) from the boiler or by a carrier gas comprising a mixture of flue gas and air.

In the fuel preparation plant, the resource fuel is either ground or shredded and then screened to remove large material prior to transport. The amount of carrier gas used is in the range of 0.5 to 2 pounds per pound of resource fuel. Illustratively a booster fan (not shown) is preferably used for the air or flue gas in order to overcome the pressure drop associated with the transport of the resource fuel to the fuel injector and the resource feed scroll. Air for transport is taken from both a fan in the fuel preparation plant and preheated air.

An aspect of the invention provides a mechanism for controlling the stoichiometry in the core of the flame, which is critical in terms of $NO_x$ reduction. The amount of air used in the transport medium can be adjusted to control the stoichiometry in the core of the flame depending upon the oxygen content of the secondary fuel. In practical terms, for a low $NO_x$ burner firing 100 percent typical bituminous coal, the core stoichiometry would be approximately 21 percent of theoretical when the coal is transported with 2 pounds of air per pound of coal. A burner cofiring 30 percent (by weight) biomass (as sawdust) and 70 percent bituminous coal would have a much greater core stoichiometry of 32 percent, if the sawdust is transported to fuel injector 100 with 1 pound of air per pound of sawdust. The core stoichiometry can be maintained at about 21 percent by using a transport gas of 0.75 pounds of flue gas and 0.25 pounds of air per pound of sawdust. The specific ratio of flue gas to air in the transport gas will depend upon the oxygen content of the resource fuel and the pounds of transport gas required per pound of resource fuel, and the desired outlet $NO_x$ level. In many applications only air would be required as the carrier gas.

In accordance with another aspect of the invention, partial drying of the secondary fuel prior to entering the combustion zone can also be accomplished by controlling the temperature of the transport gas for the resource fuel. Such partial drying causes devolatilization to occur earlier in the combustion zone thus allowing more effective reduction of $NO_x$. Resource fuels such as a biomass fuel can contain up to 50 percent moisture on an as-received basis. Laboratory results show that these fuels can lose most of this moisture when heated to approximately 200° Fahrenheit (F.). The temperature of the biomass fuel entering fuel injector 100 can be controlled in the range of 150° F. to 200° F. by using flue gas and preheated air, tempered with cold air from the fan in the respective fuel preparation plant. Partial drying of the biomass fuel prior to entering fuel injector 100 will then hasten the release of volatiles from the biomass fuel once it enters the combustion zone.

Laboratory tests further show that some biomass fuels release volatiles simultaneously with moisture as they are heated. Consequently, it may also be possible to release some of the volatiles from the biomass fuel along with moisture by a preheating method in accordance with this invention. Release of volatiles from the biomass fuel prior to entering the combustion zone will enhance their $NO_x$ reduction effect, compared to the release of the volatiles in the combustion zone of the furnace.

An example of partial drying of a secondary fuel is given for a biomass fuel that is transported to fuel injector 100 with 0.75 pounds of recycled flue gas and 0.25 pounds of air. Preheated air at 200° F. and flue gas at 280° F. provides a transport gas with a temperature of 260° F. With the biomass fuel at 70° F., the temperature of the biomass/transport gas entering fuel injector 100 will be approximately 150° F., which will provide significant drying of the biomass fuel. The precise temperature required and the extent of drying will depend upon the type of biomass fuel and its moisture content. This temperature can be controlled by varying the amount of tempering air used for the transport gas. The temperature of the resource fuel entering the fuel injector must be kept below its ignition temperature and will depend on the reactivity of the specific fuel. The use of heated air or flue gas plus air to transport the biomass to the burner while partially devolatizing further enhances the combustibility of the biomass.

Figure 4:
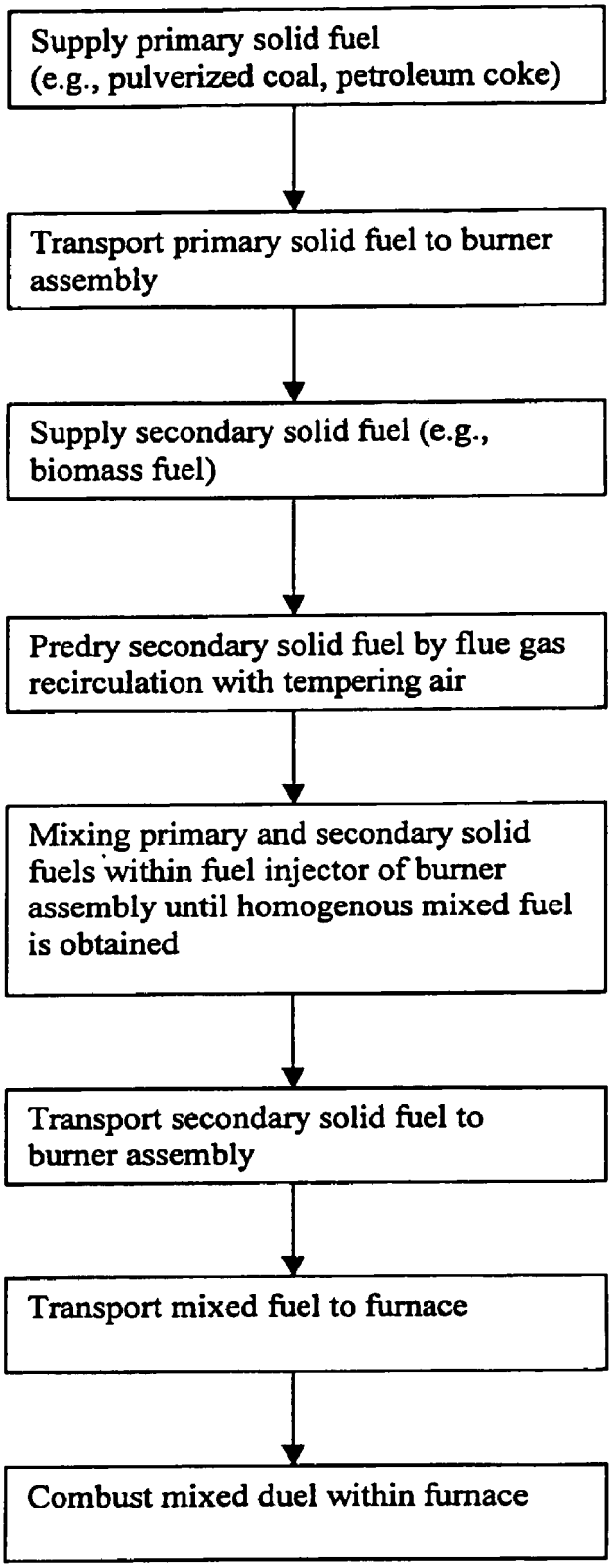
FIG. 4 is a block diagram illustrating a preferred process according to the principles of the invention.

Alternatively, or in addition to the above, the biomass fuel may be dried prior to transport to the burner system, i.e., predryed, so as to allow the moisture to be vented to the atmosphere thereby increasing the heating value of the biomass as fired, i.e., minimizing boiler efficiency losses. For example, the use of FGR with tempering air to adjust the drying temperature drives off moisture without also devolatizing the biomass. FIG. 4 illustrates in block diagram format, a preferred method of burning a plurality of solid fuels, where the fuels are mixed prior to being delivered to a furnace for combustion. The method particularly illustrates the steps of supplying a primary solid fuel (e.g., pulverized coal, petroleum coke, etc.); transporting the primary solid fuel to a burner assembly; supplying a secondary solid fuel (e.g., biomass fuel); predrying the secondary solid fuel by flue-gas recirculation with tempering air; transporting the secondary solid fuel to a burner assembly; mixing the primary and secondary solid fuels within a fuel injector of the burner assembly until a homogeneous mixed fuel is obtained; transporting the mixed fuel to a furnace; and, combusting the mixed fuel within the furnace.

Another application of the cofiring burner system of FIG. 1 is where the secondary fuel is a low volatile, hard to burn fuel such as petroleum coke. This fuel is also hard to grind, thus making it even more difficult to ignite and burn than coal. The primary fuel is illustratively a high volatile, reactive fuel such as lignite or subbituminous coal form of pulverized coal. In this application the petroleum coke is ground separately in a specially designed apparatus to yield the fineness required to enhance flame stability and yield better burnout of the petroleum coke. The petroleum coke is transported by air from a preparation plant such as a ball mill (not shown in FIG. 1) that is specifically designed to pulverize hard to grind fuels. Typically, the amount of transport air (primary air) required ranges from about 1.2 to 1.5 pounds per pound of pulverized petroleum coke. In order to maintain good flame stability, the petroleum coke must be ground so that 99.5 percent of the material passes a 50 mesh screen.

The primary fuel in this application is a high volatile, reactive low rank coal such as a subbituminous or lignite. As noted above, fuel injector 100 provides intimate mixing of the primary and secondary fuels. As such, good flame stability is maintained. The percentage of petroleum coke that is cofired with the coal can therefore be increased, compared to previous cofiring methods. In addition, this reduces fly ash UBC.

In another illustrative application of a cofiring burner system comprising a fuel injector that mixes a primary solid fuel with a secondary solid fuel, the primary solid fuel is a low volatile fuel, such as a petroleum coke, and the secondary solid fuel is a highly volatile fuel, such as a biomass fuel.

Figure 3:
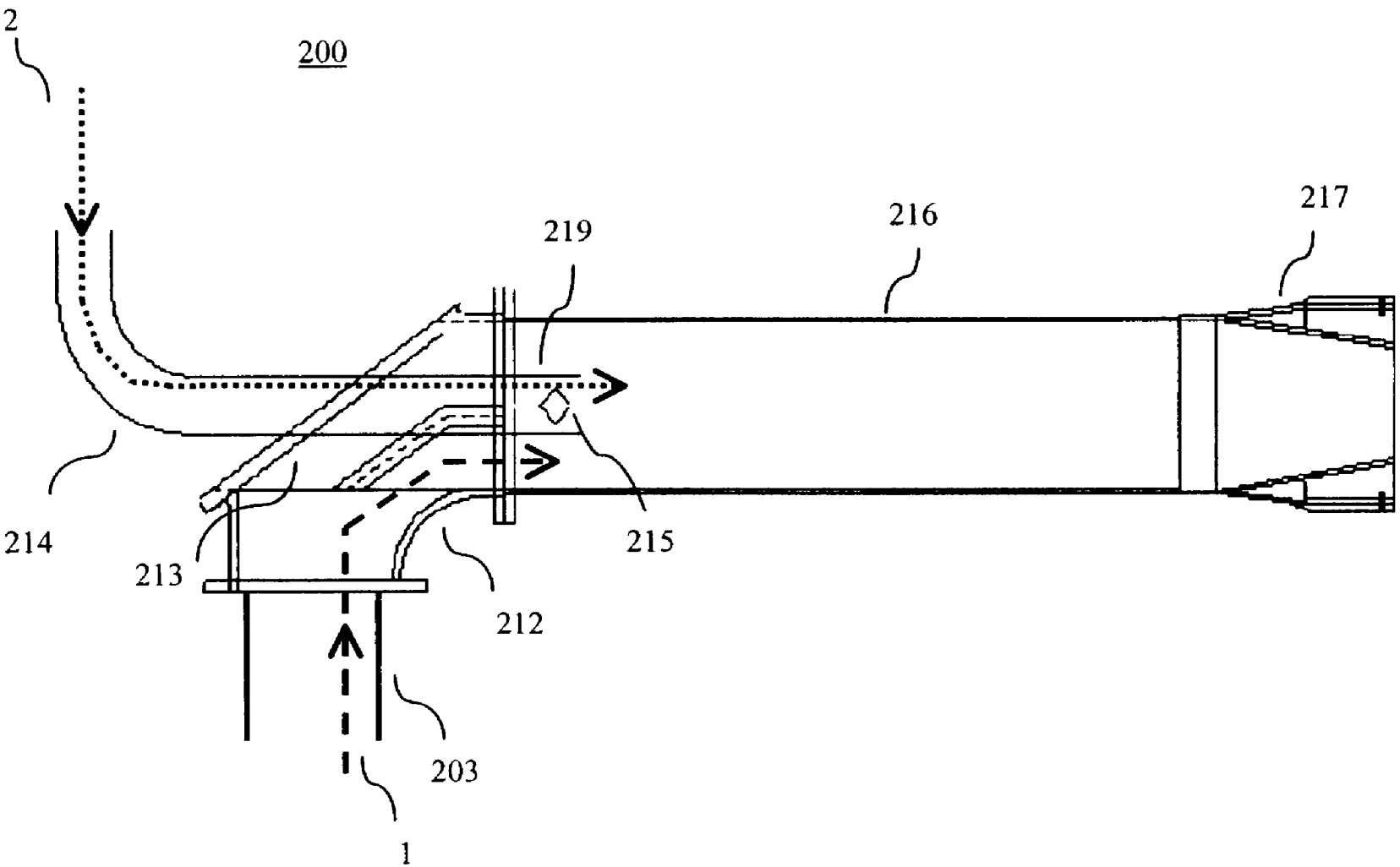
FIG. 3 is a sectional view of another burner assembly in accordance with the principles of the invention.

Turning now to FIG. 3, another illustrative embodiment of a fuel injector in accordance with the principles of the invention is shown. Fuel injector 200 may also be used in the cofiring burner system 10 of FIG. 1 and in either of the above-described applications. Fuel injector 200 is an elbow-type fuel injector. The primary fuel (e.g., pulverized coal) is fed along with primary air from a mill through a feed pipe 203 to a primary port, or inlet of fuel injector 200. In this example, the primary inlet of fuel injector 200 is elbow 212. Fuel distributors 213 are used to provide near axial flow of the primary fuel as it exits the coal elbow. The primary fuel then enters the barrel 216. The movement of the primary fuel in fuel injector 200 toward barrel 216 is illustratively represented in FIG. 3 by dashed line 1.

Secondary fuel enters a secondary port, or inlet, of fuel injector 200 axially. The secondary inlet is represented by feed pipe 214 at the end of fuel injector 200. The secondary fuel feed pipe 214 is preferably sized so as to provide a velocity of between 50 and 100 feet per second for the secondary fuel as it exits the feed pipe 214 into barrel 216. The movement of the secondary fuel in fuel injector 200 into barrel 216 is illustratively represented in FIG. 3 by dashed line 2. Barrel 216 is illustratively a mixing chamber of fuel injector 200. An impeller, or other spreading device, 215 is used to yield an intimate mixture of the secondary fuel with the primary fuel as they enter barrel 216, of fuel injector 200. The impeller 215 is illustratively located within a barrel 219 coupled to the secondary fuel feed pipe 214. The intimately mixed fuel then exits the burner tip 217 (or nozzle) in a nearly uniform distribution around the circumference of the tip. As an alternative to the impeller 215, a diffuser can be inserted in the pulverized coal stream surrounding the secondary fuel injection pipe 214 to provide intimate mixing of the two fuels.

In the application where the secondary fuel is a high volatile, resource fuel, it is preferably transported from a fuel preparation plant by a flue gas that is recycled after the air heater from the boiler or a mixture of flue gas and air. The amount of air used in the transport medium can be adjusted to control the stoichiometry in the core of the flame depending upon the oxygen content of the secondary fuel, the pounds of transport gas used per pound of resource fuel and the desired $NO_x$ level. As with the embodiment of FIG. 2 discussed above, the temperature of the transport medium can be controlled in the range of 150° F. to 200° F. in order to provide partial drying of the secondary fuel prior to entering the combustion zone. In the application where the secondary fuel is petroleum coke, the petroleum coke is transported by air from a preparation plant such as a ball mill that is specifically designed to pulverize hard to grind fuels to a size consistency such that 99.5 percent of the material passes a 50 mesh screen.

As described above, the inventive concept provides a method and apparatus for mixing two or more solid fuels prior to injection into a combustion zone of a furnace. Illustratively, and in accordance with an aspect of the invention, a furnace system comprises a burner assembly having a mixing device where a primary fuel and a secondary fuel are intimately mixed to form a new homogenous fuel stream prior to being injected into a combustion zone of a furnace. Such a system permits a greater percentage of a secondary fuel to be co-fired with coal to maintain flame stability and reduce NOx formation. This is especially advantageous because it permits inexpensive fuels having low combustibility (such as petcoke), which was previously regarded as a waste product, to be burned along with a fuel having high combustibility, such as sawdust. Alternatively, pulverized coal and sawdust, or other biomass fuel, can be mixed. In such an embodiment, the amount of coal used in the system can be reduced in proportion to the amount of biomass fuel introduced into the system. Indeed, a biomass fuel is cheaper than coal, making such a method and apparatus not only environmentally safe, but also cost-effective. Moreover, the amount of a secondary biomass fuel introduced into a furnace system can be increased, while significantly reducing NOx formation. In other words, and in accordance with an aspect of the invention, intimate mixing of a high volatile, secondary fuel with a primary fuel prior to entering the combustion zone will enhance reduction in NO emissions.

Although the invention herein has been described with reference to particular embodiments, it is to be understood that these embodiments are merely illustrative of the principles and applications of the present invention. For example, the inventive concept applies to any burner used in a combustion process and is applicable to different types of fuel injectors that fire into a furnace. Also, although the inventive concept was described in the context of a scroll-type fuel injector and an elbow-type fuel injector, it is not required that a fuel injector embodying the principles of the invention be of only one type or the other. Further, although illustrated in the context of a primary fuel and a secondary fuel, the inventive concept is applicable to the mixing of two powders. It is therefore to be understood that numerous modifications may be made to the illustrative embodiments and that other arrangements may be devised without departing from the spirit and scope of the present invention as defined by the appended claims.

What is claimed is:

1. A fuel injector comprising:

a primary inlet port for receiving a primary solid fuel;

a secondary inlet port for receiving a secondary solid fuel;

a mixing chamber including a mixing element within said fuel injector arranged downstream of the primary and secondary inlet ports for mixing intimately the primary solid fuel and the secondary solid fuel to provide a substantially homogenous mixed solid fuel, the mixing element being a diffuser or an impeller; and a nozzle arranged downstream of the mixing chamber at a distal end of the fuel injector for providing the mixed solid fuel to a combustion chamber.

2. The fuel injector of claim 1, wherein the fuel injector is a scroll-type.

3. The fuel injector of claim 1, wherein the fuel injector is a elbow-type.

4. The fuel injector of claim 1, wherein the fuel injector includes an impeller for intimately mixing the primary solid fuel and the secondary solid fuel.

5. The fuel injector of claim 1, wherein the fuel injector includes a diffuser element for intimately mixing the primary solid fuel and the secondary solid fuel.

6. The fuel injector of claim 1, wherein the primary solid fuel is pulverized coal.

7. The fuel injector of claim 1, wherein the primary solid fuel is petroleum coke.

8. The fuel injector of claim 1, wherein the secondary solid fuel is a biomass fuel.

9. The fuel injector of claim 8, wherein the biomass fuel is predryed.

10. The fuel injector of claim 1, wherein the secondary solid fuel is petroleum coke.

11. A fuel injector for use in a furnace, the fuel injector comprising:

a first inlet for receiving a primary solid fuel;

a second inlet for receiving a secondary solid fuel;

at least one elongated barrel connected to the first inlet or the second inlet;

a mixing chamber connected to the at least one elongated barrel for mixing the primary solid fuel with the secondary solid fuel; and a nozzle at a distal end of the fuel injector for providing the mixed primary solid fuel and the secondary solid fuel to a combustion chamber.

12. The fuel injector of claim 11, wherein at least one of the first inlet and the second inlet is a scroll-type inlet.

13. The fuel injector of claim 11, wherein at least one the first inlet and the second inlet are elbow-type inlets.

14. The fuel injector of claim 11, wherein the mixing chamber includes a mixing element for mixing together the primary solid fuel and the secondary solid fuel.

15. The fuel injector of claim 14, wherein the mixing element is a diffuser element.

16. The fuel injector of claim 14, wherein the mixing element is an impeller.

17. The fuel injector of claim 11, wherein the primary solid fuel is pulverized coal.

18. The fuel injector of claim 11, wherein the primary solid fuel is petroleum coke.

19. The fuel injector of claim 11, wherein the secondary solid fuel is a biomass fuel.

20. The fuel injector of claim 19, wherein the biomass fuel is predryed.

21. The fuel injector of claim 11, wherein the secondary solid fuel is petroleum coke.

22. A cofiring burner system comprising:

a furnace;

at least one primary feed pipe for providing a primary solid fuel;

at least one secondary feed pipe for providing a secondary solid fuel; and at least one fuel injector abutting the furnace for mixing the primary solid fuel and the secondary solid fuel within the fuel injector and for providing the mixed fuel to the furnace for combustion therein, the at least one fuel injector being a scroll-type or elbow-type of fuel injector.

23. The cofiring burner system of claim 22, wherein the fuel injector includes a mixing element for mixing the primary solid fuel and the secondary solid fuel.

24. The cofiring burner system of claim 23, wherein the mixing element is a diffuser element.

25. The cofiring burner system of claim 23, wherein the mixing element is an impeller.

26. The cofiring burner system of claim 22, wherein the primary solid fuel is pulverized coal.

27. The fuel injector of claim 22, wherein the primary solid fuel is petroleum coke.

28. The cofiring burner system of claim 22, wherein the secondary solid fuel is a biomass fuel.

29. The cofiring burner system of claim 28, wherein the biomass fuel is predryed.

30. The cofiring burner system of claim 22, wherein the secondary solid fuel is petroleum coke.

31. A method of burning a plurality of solid fuels, the method comprising:

supplying a primary solid fuel to a burner assembly;

supplying a secondary solid fuel to the burner assembly;

mixing in a scroll-type or elbow-type fuel injector the primary solid fuel and the secondary solid fuel in the burner assembly until a homogenous mixed fuel is obtained prior to delivering the mixed fuel to a furnace;

providing the mixed fuel to a furnace; and combusting the mixed fuel in the furnace.

32. The method of claim 31, wherein the mixing step intimately mixes the primary solid fuel and the secondary solid fuel together.

33. he method of claim 31, wherein the primary solid fuel is pulverized coal.

34. The fuel injector of claim 31, wherein the primary solid fuel is petroleum coke.

35. The method of claim 31, wherein the secondary solid fuel is a biomass fuel.

36. The method of claim 35, wherein the supplying the secondary solid fuel step includes the step of predrying the biomass fuel.

37. The method of claim 36, wherein the step of predrying the biomass fuel occurs before transport to the burner assembly.

38. The method of claim 36, wherein the step of predrying the biomass fuel includes the step of using flue gas recirculation.

39. The method of claim 36, wherein the step of predrying the biomass fuel includes the step of using flue gas recirculation with tempering air.

40. The method of claim 31, wherein the secondary solid fuel is petroleum coke.

41. A fuel injector comprising:

a primary inlet port for receiving pulverized coal or petroleum coke as a primary solid fuel;

a secondary inlet port for receiving a secondary solid fuel;

a mixing chamber within said fuel injector arranged downstream of the primary and secondary inlet ports for mixing the primary solid fuel and the secondary solid fuel to provide a mixed solid fuel; and a nozzle arranged downstream of the mixing chamber at a distal end of the fuel injector for providing the mixed solid fuel to a combustion chamber.

42. A cofiring burner system comprising:

a furnace;

at least one primary feed pipe for providing a primary solid fuel;

at least one secondary feed pipe for providing a secondary solid fuel; and at least one fuel injector abutting the furnace for mixing with a mixing element the primary solid fuel and the secondary solid fuel within the fuel injector and for providing the mixed fuel to the furnace for combustion therein, the mixing element being a diffuser or an impeller.

* * * * *

UNITED STATES PATENT AND TRADEMARK OFFICE

CERTIFICATE OF CORRECTION

PATENT NO. : 6,986,311 B2
DATED : January 17, 2006
INVENTOR(S) : Joel Vatsky and Richard E. Conn It is certified that error appears in the above-identified patent and that said Letters Patent is hereby corrected as shown below:

Column 11,
Line 6, "he" should read -- The --.

Signed and Sealed this

Second Day of May, 2006

JON W. DUDAS
*Director of the United States Patent and Trademark Office*